US006715900B2

(12) United States Patent
Zhang

(10) Patent No.: US 6,715,900 B2
(45) Date of Patent: Apr. 6, 2004

(54) LIGHT SOURCE ARRANGEMENT

(75) Inventor: Long Bao Zhang, Anaheim, CA (US)

(73) Assignee: A L Lightech, Inc., Anaheim, CA (US)

( * ) Notice: Subject to any disclaimer, the term of this patent is extended or adjusted under 35 U.S.C. 154(b) by 0 days.

(21) Appl. No.: 10/150,739

(22) Filed: May 17, 2002

(65) Prior Publication Data

US 2003/0214810 A1 Nov. 20, 2003

(51) Int. Cl.[7] ..... F21V 29/00
(52) U.S. Cl. ..... 362/294; 362/223; 362/800
(58) Field of Search ..... 362/235, 237, 362/240, 244, 246, 249, 251, 294, 373, 800

(56) References Cited

U.S. PATENT DOCUMENTS 6,161,910 A * 12/2000 Reisenauer et al. ..... 362/235
6,220,722 B1 * 4/2001 Begemann ..... 362/294
6,425,678 B1 * 7/2002 Verdes et al. ..... 362/294
2003/0063476 A1 * 4/2003 English et al. ..... 362/800

* cited by examiner

*Primary Examiner*—Y My Quach Lee
(74) *Attorney, Agent, or Firm*—Raymond Y. Chan; David and Raymond Patent Group

(57) ABSTRACT

A light source arrangement includes an electric input adapter for electrically connecting with a power source and a light head including a supporting frame and a luminary unit. The supporting frame has a dissipating end and a peripheral surface provided thereon. The luminary unit includes a circuit board provided on the peripheral surface of the supporting frame and electrically connected with the electric input adapter, and at least a luminary element, having two terminal electrodes, which is supported by the supporting frame and electrically connected to the circuit board for emitting light when the terminal electrodes are electrified. Therefore, the heat generated by the luminary element directly dissipates at the dissipating end of the supporting frame so as to prevent the light head from overheating.

42 Claims, 7 Drawing Sheets

LIGHT SOURCE ARRANGEMENT

BACKGROUND OF THE PRESENT INVENTION

1. Field of Invention

The present invention relates to a high efficiency solid-state light source, and more particularly to a light source arrangement which can enhance brightness of the emitting light and increase the cooling effect of the light source arrangement.

2. Description of Related Arts

Nowadays, the most common light sources for illumination are filament lamp bulb and LED lighting. Due to the remarkable features of low power consumption and instant light emission, LED lighting is specially adapted to be utilized in many electrical appliances, such as the power on-off signal light and instructional signal light of electric equipment, indicating light of electronic clock, and etc . . .

Due to the technology of LED, the LED, nowadays, not only has excellent properties of low power consumption and instant light emission but also provides a relatively high light intensity and lighting emission angle of the LED such that the LED becomes one of the common lighting apparatus applied in some specific area such as traffic light, signboard light, vehicle brake light and signal light, and airport guiding lighting.

Moreover, the generation of LED has been changed from a single bonded diode to a double bonded diode wherein the single bonded diode is that the luminary element has an upper positive charged terminal electrically connected to a negative charged terminal of the circuit board and a lower negative charged terminal electrically connected to a positive charged terminal of the supporting stem. The double bonded diode contains both positive charged terminal and negative charged terminal provided on the upper portion of the double bonded diode in such a manner that the positive and negative charged terminals are adapted to electrically connected to the negative and positive charged terminals of the circuit board. Therefore, the double bonded diode is adapted to carry more than one luminary element having different wavelengths for generating various colors such as blue, green, yellow, red, or even white.

Furthermore, the problem of overheat of the LED can be solved since there is no electrical connection between the luminary element and the supporting stem, such that by incorporating with a heat sink, the heat generated by the luminary element will be directly dissipated by the heat sink. Accordingly, the normal operation temperature of the luminary element is determined by the formula: $Tj=Ta+If*Vf*Rth$, where Tj is the temperature between the luminary element and the circuit board, Ta is the ambient temperature, If is the operation current passing through the LED, Vf is the operation voltage, and the Rth is the heat resistant coefficient. In order to enhance the light intensity of the LED, especially when a plurality of luminary elements are utilized therewith, a larger current and a larger voltage can be applied to the LED. However, when increasing the current, heat is generated from the LED in such a manner that when the heat cannot be dissipated properly, the heat may bum the LED. Therefore, the heat sink must be incorporated well to efficiently dissipate the heat.

Another problem is that when the LED comprises a plurality of luminary elements, the electrical arrangement of the circuit board is complicated to electrically connect with the luminary elements. Therefore, the circuit board must be increased its size to connect with the luminary elements in order to maintain the lower manufacturing cost of the LED. However, the overall size of the LED will be substantially increased by the size of the circuit board. Thus, for the application of the LED, the electric plug of the electric apparatus must be altered in order to fit the electrical connection of the LED, which is costly.

SUMMARY OF THE PRESENT INVENTION

A main object of the present invention is to provide a light source arrangement which can enhance brightness of the emitting light and increase the cooling effect of the light source arrangement.

Another object of the present invention is to provide a light source arrangement, which comprises a plurality of luminary elements supported by a supporting frame, wherein a circuit board is provided on an outer surface of the supporting frame to electrically connect with the luminary elements so as to not only simplify the electrical connection therebetween but also minimize the installation space for the circuit board.

Another object of the present invention is to provide a light source arrangement, which comprises a heat dissipating member mounted to the supporting frame having good heat conductivity, in such a manner that the heat dissipating member can highly increase the cooling effect of the light source arrangement to vanish the heat from the light head through the supporting frame so as to prolong the service life span thereof.

Another object of the present invention is to provide a light source arrangement which comprises a universal input adapter adapted to plug into an electric outlet of an electric apparatus. In other words, the electric apparatus does not require altering its electric apparatus in order to incorporate with the light source arrangement of the present invention.

Another object of the present invention is to provide a light source arrangement, wherein either single bonded diode or double bonded diode can be utilized to the light source arrangement without altering the original structural design of the light source arrangement.

Accordingly, in order to accomplish the above objects, the present invention provides a light source arrangement, comprising:

- an electric input adapter adapted for electrically connecting with a power source; and
- a light head, comprising:
  - a supporting frame having first dissipating end, an opposed second dissipating end, and a peripheral surface provided between the first and second dissipating ends; and
- a luminary unit comprising a circuit board provided on the peripheral surface of the supporting frame and electrically connected with the electric input adapter, and at least a luminary element, having two terminal electrodes, which is supported by the supporting frame and electrically connected to the circuit board for emitting light when the terminal electrodes are electrified.

DETAILED DESCRIPTION OF THE PREFERRED EMBODIMENT

Figure 1:
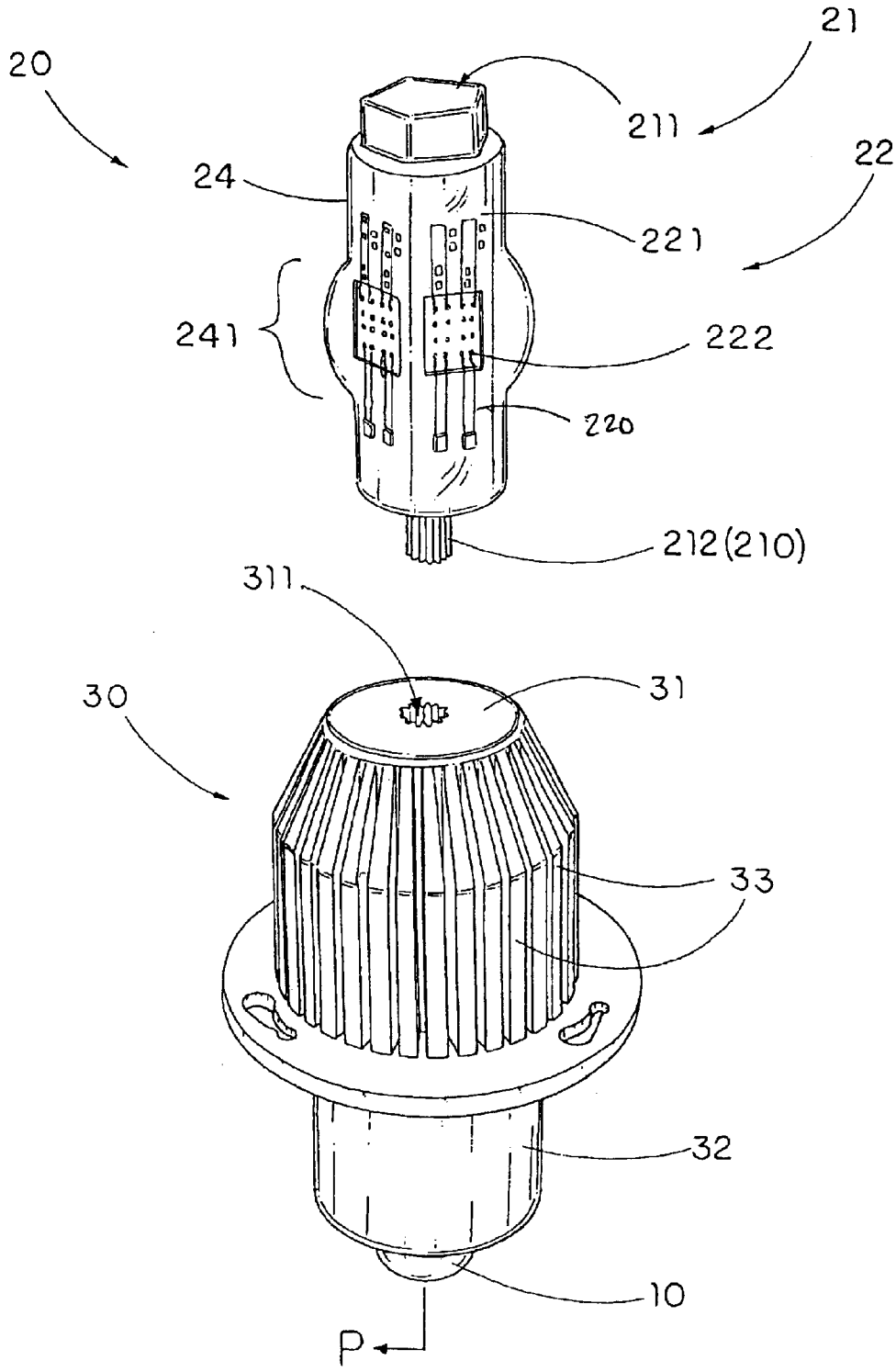
FIG. 1 is an exploded perspective view of a light source arrangement according to a first preferred embodiment of the present invention.
Figure 2:
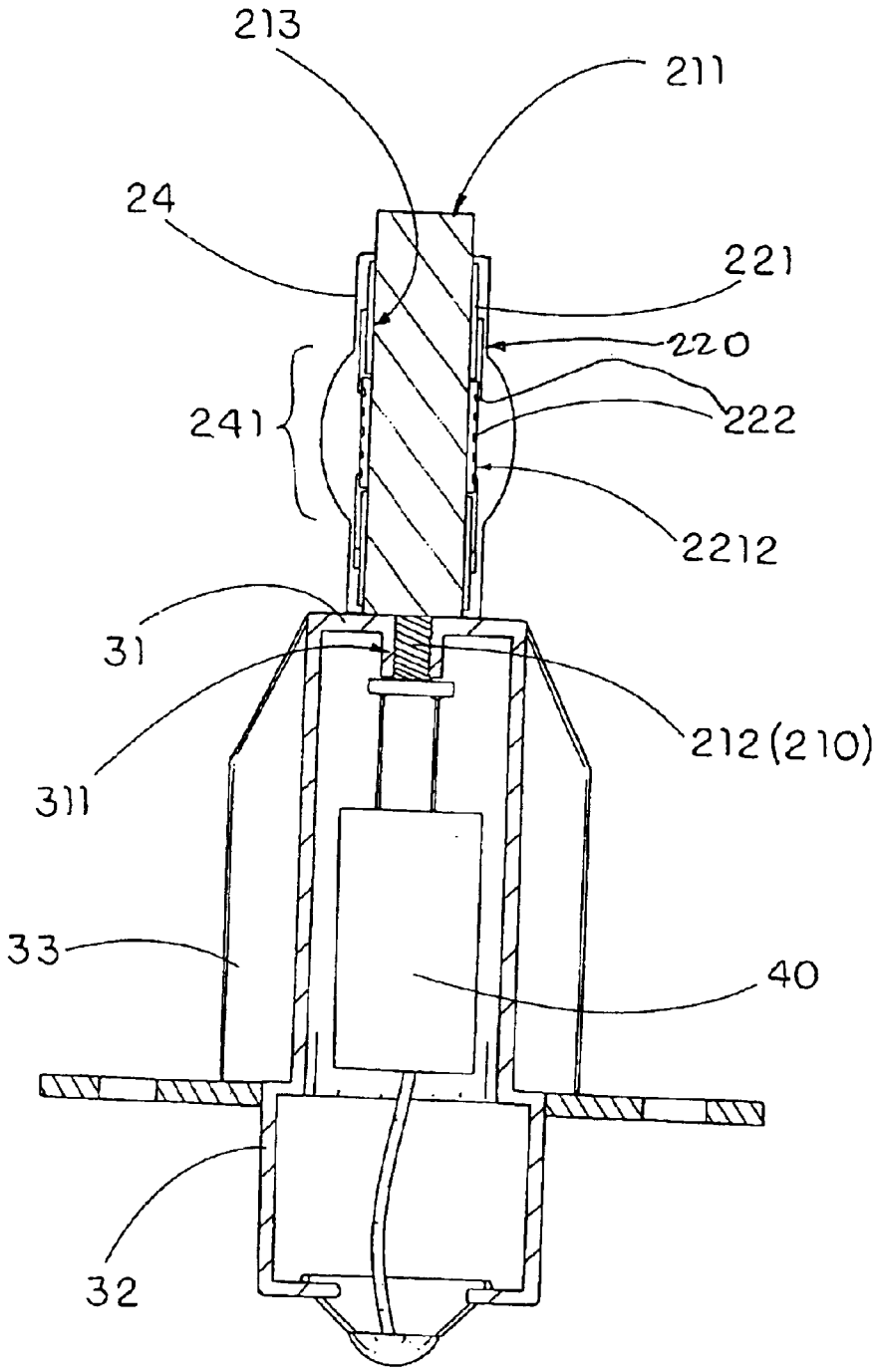
FIG. 2 is a sectional view of the light source arrangement according to the above first preferred embodiment of the present invention.
Figure 3:
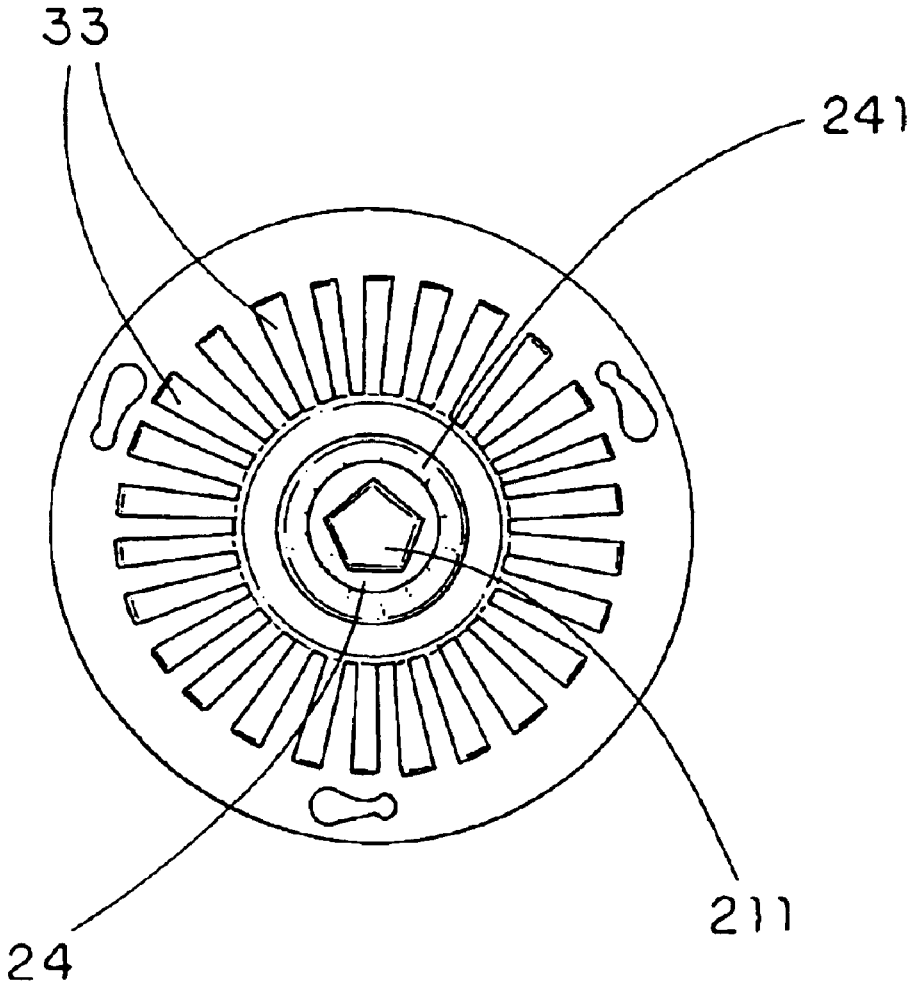
FIG. 3 is a top view of the light source arrangement according to the above first preferred embodiment of the present invention.

Referring to FIGS. 1 through 3 of the drawings, a light source arrangement according to a first preferred embodiment of the present invention is illustrated, wherein the light source arrangement comprises an electric input adapter 10 adapted for electrically connecting with a power source P and a light head 20.

The light head 20 comprises a supporting frame 21 having first dissipating end 211, an opposed second dissipating end 212, and a peripheral surface 213 provided between the first and second dissipating ends 211, 212, and a luminary unit 22 comprising a circuit board 221 provided on the peripheral surface 213 of the supporting frame 21 and electrically connected with the electric input adapter 10, and at least a luminary element 222, having two terminal electrodes, which is supported by the supporting frame 21 and electrically connected to the circuit board 221 for emitting light when the terminal electrodes are electrified.

According to the preferred embodiment, the supporting frame 21 which is made of good heat conduction material, is constructed to have an elongated solid member solidly extended from the first dissipating end 211 to the second dissipating end 212 so as to rigidly support the luminary unit 22 thereon. However, the supporting frame is adapted to construct as an elongated hollow member to reduce the overall weight of the light head 20. Accordingly, the supporting frame 21 can be formed to have a circular cross section, triangular cross section, rectangular cross sectional, or polygonal cross section in order to form the peripheral surface 213 between the first and second dissipating ends 211, 212 of the supporting frame 21.

As shown in FIGS. 1 and 2, the luminary element 222 is mounted on the peripheral surface 213 of the supporting frame 21 to electrically connect with the circuit board 221. According to the preferred embodiment, the luminary element 222 is a double bonded diode has two terminal electrodes 220 electrically connected to the circuit board 221 in such a manner that the light is emitted by the luminary element 222 when the two terminal electrodes 220 are electrified. Practically, different kinds of luminary element 222 can produce different colors of light such as red, blue, or green. It is worth mentioning that the luminary element 222 can be the single bonded diode having one terminal electrode 220 electrically connected to the supporting frame 21 while another terminal electrode 220 electrically connected to the circuit board 221.

Figure 4:
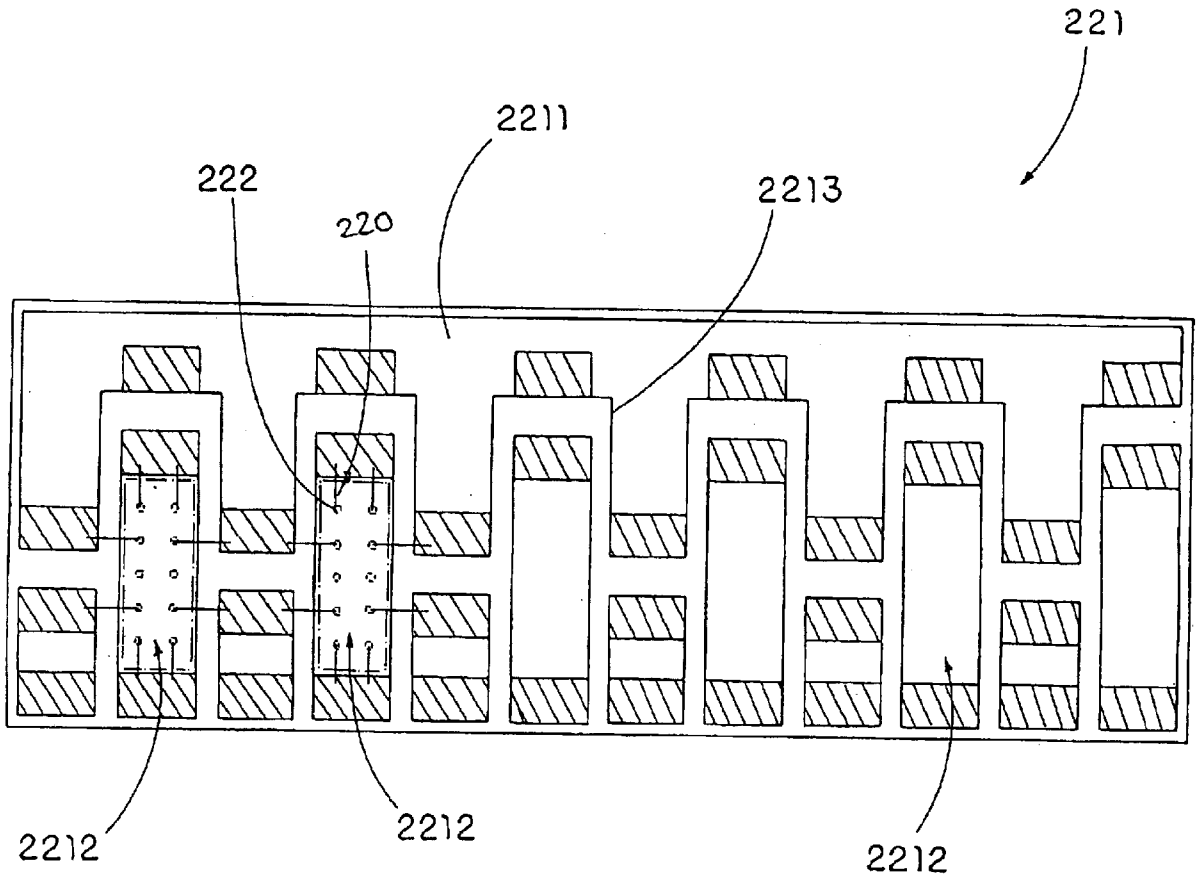
FIG. 4 illustrates a circuit board of the light source arrangement according to the above first preferred embodiment of the present invention.

As shown in FIG. 4, the circuit board 221 has at least a guiding window 2212 arranged in such a manner that when the circuit board 221 is provided on the peripheral surface 213 of the supporting frame 21, the luminary element 222 is provided on the peripheral surface 213 of the supporting frame 21 at a position within the guiding window 2212 to electrically connect with the circuit board 221.

Accordingly, the circuit board 221 comprises an elastic board layer 2211 firmly attached to the peripheral surface 213 of the supporting frame 21 by glue and a circuit arrangement 2213 provided on the board layer 2211 wherein the guiding window 2212 is formed on the board layer 2211 in such a manner that the luminary element 222 is positioned at the guiding window 2212 to electrically connect with the circuit arrangement 2213.

According to the technology of making semi-conductor, the circuit board 221 is adapted to be directly imprinted on the peripheral surface 213 of the supporting frame 21 so that the luminary element 222 is mounted on peripheral surface 213 the supporting frame 21 within the guiding window 2112 to electrically connect with the circuit board 221.

Figure 5:
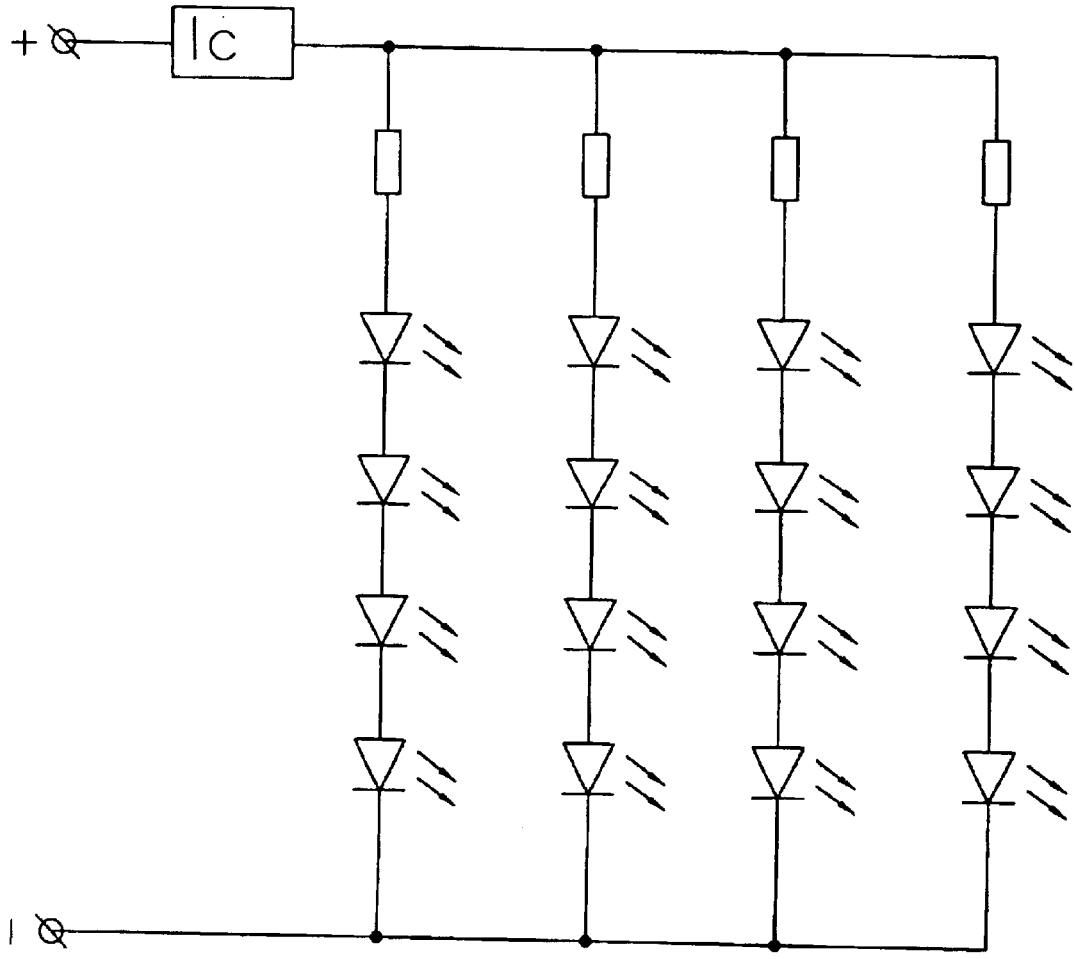
FIG. 5 is a circuit diagram of the light source arrangement according to the above first preferred embodiment of the present invention.

Due to the physical structure of the supporting frame 21, a plurality of luminary elements 222 is adapted to be mounted on the peripheral surface 213 of the supporting frame 21 within the guiding windows 2212. Therefore, the luminary elements 222 are arranged to electrically connect with the circuit board 221 in a serial connection and/or a parallel connection, as shown in FIG. 5. In other words, different kinds of luminary elements 222 are adapted to mount on the supporting frame 21 to produce different colors of light. Therefore, by arranging the electrical connection, i.e. serial and parallel connections, a sequence of lighting effect can be produced. Accordingly, when red, green, and blue colors are produced at the same time by the luminary elements 222 respectively, the light head 20 is adapted to form a white light.

In order to protect the luminary element 222, the light head 20 further comprises a transparent light shelter 24 sealedly mounted on the peripheral surface 213 of the supporting frame 21 to sealedly protect the circuit board 221 and the luminary element 222. As shown in FIGS. 1 and 2, the light shelter 24, which is preferably made of resin or other similar material having high thermo-resistance ability, has a light projecting portion 241 provided on the supporting frame 21 at a position aligning with the luminary element 222 in such a manner that the light produced by the luminary element 222 is arranged to pass through the light projecting portion 241 of the light shelter 24 to outside.

The light projecting portion 241 of the light shelter 24 having a spherical shaped is adapted to amplify the light from the luminary element 222 so as to enhance the light intensity of the light head 20. Preferably, the luminary element 222 is positioned close to a focus point of the light projecting portion 241 of the light shelter 24 to evenly distribute the light threrethrough.

Since the first and second heat dissipating ends 211, 212 of the supporting frame 21 are exposed outside without sealedly covering by the light shelter 24, the heat generated by the luminary element 222 can be effectively dissipated at the first and second heat dissipating ends 211, 212 of the supporting frame 21.

It is worth mentioning that both the circuit board 221 and the luminary element 222 are sealed between the light shelter 24 and the peripheral surface 213 of the supporting frame 21, the light shelter 24 not only secures the electrical connection between the circuit board 221 and the luminary element 222 due to the external vibration force but also protects the luminary element 222 from being damaged by collision.

According to the preferred embodiment, the light source arrangement further comprises a heat dissipating member 30 mounted to the second dissipating end 212 of the supporting frame 21 to dissipate heat generated from the light head 20. As shown in FIG. 1, the second dissipating end 212 of the supporting frame 21 is embodied as a heat sink connector 210 to securely connect with the heat dissipating member 30 so as to directly distribute the heat from the light head 20 to the heat dissipating member 30.

The heat dissipating member 30, which is made of material having good heat conductivity, comprises a supporting ceiling 31 having a central head socket 311, a base 32 and a plurality of heat dissipating blades 33 integrally and spacedly extended from the supporting ceiling 31 to the base 32 in such a manner that the heat sink connector 210 (the second dissipating end 212 of the supporting frame 21) is fittedly inserted into the head socket 311 so as to substantially mount the light head 20 on the heat dissipating member 30.

When the terminal electrodes of the luminary elements 222 are electrified, the luminary element 222 not only emits light but also generates heat which may burn off the luminary element 222 itself while the luminary element 222 is overheated, especially over a period of continued use of the light head 20. Due to the structure of the heat dissipating blades 33, the contacting surface of the heat dissipating member 30 will be substantially increased to effectively dissipate the heat from the light head 20.

As shown in FIG. 1, the heat sink connector 210 having a cog-liked cross sectional is fittedly inserted into the head socket 311 having the corresponding shaped so as to substantially increase the contacting surface area between the light head 20 and the heat dissipating member 30 for further enhancing the heat transfer from the light head 20 to the heat dissipating member 30. Moreover, the cog-like cross sectional heat sink connector 210 is adapted to prevent an unwanted rotational movement of the light head 20 with respect to the heat dissipating member 30 when the heat sink connector 210 is engaged with the heat dissipating member 30.

It is worth mentioning that when the light head 20 is continuously utilized over a period of time, the surface of the light shelter 24 is still warm that the user is able to touch without burning his or her hand, since almost of the heat produced by the luminary element 222 is transferred to the heat dissipating member 30 through the supporting frame 21. In other words, the light head 20 of the present invention will not be overheated over a period of continued used.

Figure 6:
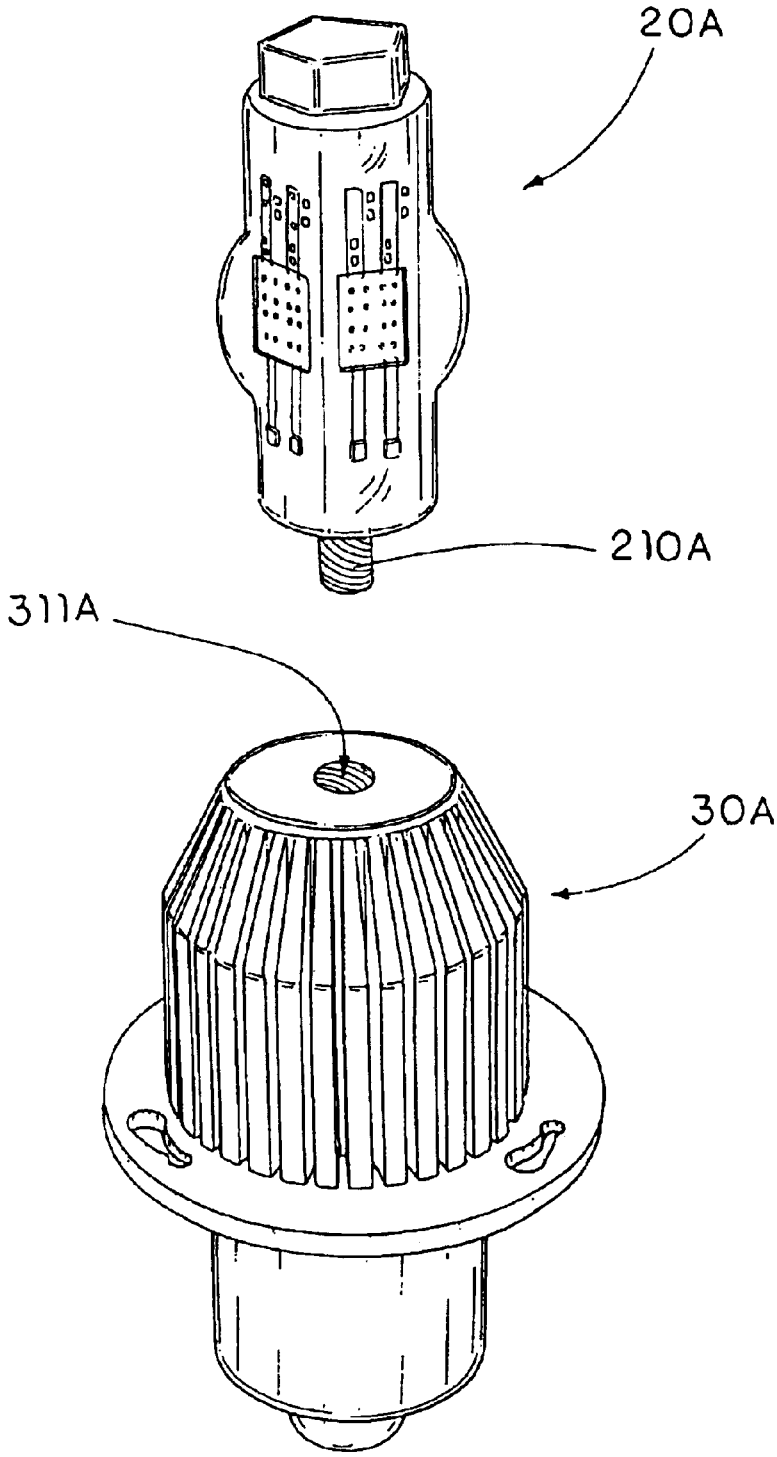
FIG. 6 illustrates an alternative mode of a heat sink connector according to the above first preferred embodiment of the present invention.

Accordingly, the light head 20A is adapted to be constructed that the heat sink connector 210A has an outer spiral threaded portion screwing with an inner spiral threaded portion of the head socket 311A such that the light head 20A is replaceably connected to the heat dissipating member 30A, as shown in FIG. 6. Even the contacting surface area of the heat sink connector 210A may lesser than that of the heat sink connector 210 having the cog-liked cross sectional, the user is able to self-replace the light head 20A so as to select desired color produced by the luminary element 222.

To achieve the best performance of the present invention, the light source arrangement further comprises a circuit control device 40 for controlling a flow of current flowing from the power source P to the circuit board 221. As shown in FIG. 2, the circuit control device 40 is an IC board received in an interior of the heat dissipating member 30 and electrically connected between the electric input adapter 10 and the circuit board 221. Alternatively, the circuit control device 40 is built-in with the circuit board 221 so as to reduce the overall size of the light source arrangement of the present invention.

The circuit control device 40 is arranged to control the flow of current for stabilizing a voltage of the circuit board 221. Thus, the circuit control device 40 is adapted to convert both AC and currents to an optimum electrical power from the power source P to the light head 20 such that light source arrangement can be installed into a vehicle while using DC current (battery) or indoors while using AC current (power outlet). Moreover, the circuit device 40 is adapted to control the flow of the current to the light head 20 in order to provide various lighting effects such as flashing or white light while more than one luminary element 222 is used.

As shown in FIG. 1, the electric input adapter 10 is provided at the base 32 of the heat dissipating member 30 wherein the electric input adapter 10 is embodied as a universal adapter adapted to plug into a conventional light bulb socket so as to electrically connect the light head 20 with the power source P while AC current is used. Alternatively, the electric input adapter 10 is adapted to electrically plug into a power outlet of a signal light of a vehicle so as to substitute the conventional light bulb for the vehicle.

Figure 7:
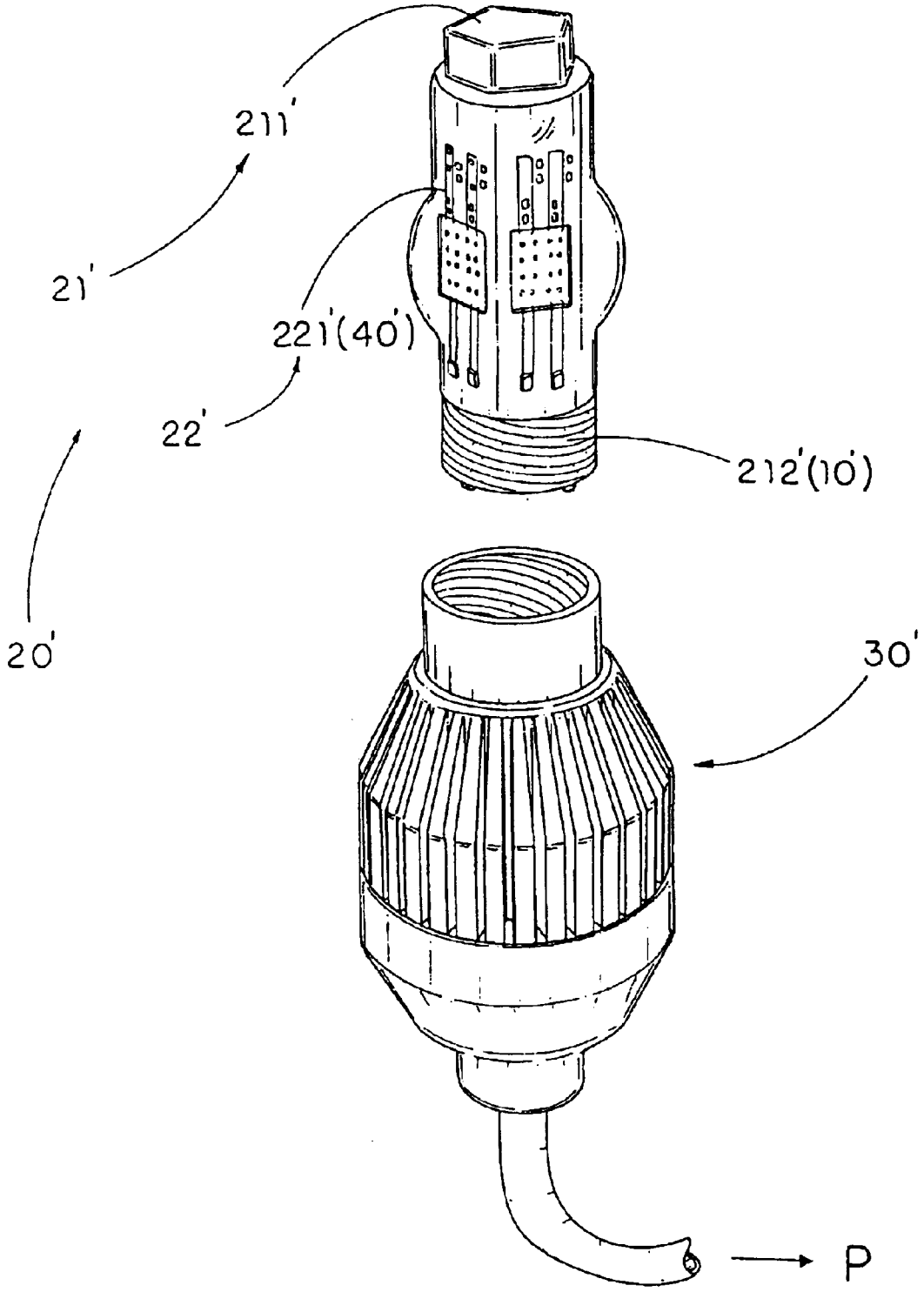
FIG. 7 is a perspective view of a light source arrangement according to a second preferred embodiment of the present invention.

Referring to FIG. 7, a light source arrangement of a second embodiment illustrates an alternative mode of the first embodiment of the present invention, wherein all the components and the structure of the light head 20', such as supporting frame 21' and the luminary unit 22', remained the same except the electric input connector 10'.

As shown in FIG. 7, the second dissipating end 212' of the supporting frame 21' is constructed to form the electric input adapter 10' such that the light head 20' is adapted to directly plug into the power outlet while the heat is dissipated at the first and second heat dissipating ends 211', 212' of the supporting frame 21'.

It is worth mentioning that the circuit control device 40' should built-in with the circuit board 221' since the light head 20' may not require to incorporate with the heat dissipating member 30'. As it is mentioned above, the electric input adapter 10' can be constructed to plug into the conventional power outlet such as light bulb socket or the signal light of the vehicle.

Furthermore, the conventional power outlet is adapted to incorporate with the heat dissipating member 30' as a heat sink for connecting the conventional light bulb so as to enhance the heat dissipation of the light bulb.

What is claimed is:

1. A light source arrangement, comprising:

an electric input adapter for electrically connecting with a power source; and a light head, comprising:

a supporting frame having at least a dissipating end and a peripheral surface provided thereon; and a luminary unit comprising:

a circuit provided on said peripheral surface of said supporting frame and electrically connected with said electric input adapter wherein said circuit comprises at least a circuit board having at least a guiding window, and at least a luminary element having two terminal electrodes, wherein said luminary element is supported by said supporting frame and electrically connected to said circuit for emitting light when said terminal electrodes are electrified, wherein when said circuit board is provided on said peripheral surface of said supporting frame, said luminary element is provided on said peripheral surface of said supporting frame at a position within said guiding window to electrically connect with said circuit board.

2. A light source arrangement, as recited in claim 1, wherein said circuit board comprises an elastic board layer firmly attached to said peripheral surface of said supporting frame and a circuit arrangement provided on said board layer wherein said guiding window is formed on said board layer so that said luminary element is positioned within said guiding window to electrically connect with said circuit arrangement.

3. A light source arrangement, as recited in claim 1, wherein said circuit board is imprinted on said peripheral surface of said supporting frame.

4. A light source arrangement, as recited in claim 1, wherein said light head further comprises a light shelter sealedly mounted on said peripheral surface of said supporting frame to sealedly protect said circuit board and said luminary element, wherein said light shelter has a light projecting portion provided on said supporting frame at a position aligning with said luminary element in such a manner that a light produced by said luminary element is arranged to pass through said light projecting portion of said light shelter to outside.

5. A light source arrangement, as recited in claim 4, further comprising a heat dissipating member mounted to said dissipating end of said supporting frame for dissipating heat generated from said light head, wherein said heat dissipating member comprises a supporting ceiling having a central head socket, a base, and a plurality of heat dissipating blades integrally and spacedly extended from said supporting ceiling to said base in such a manner that said dissipating end is structured as a heat sink connector to fittedly insert into said head socket so as to mount said light head on said heat dissipating member.

6. A light source arrangement, as recited in claim 5, wherein said heat sink connector having a cog-liked cross sectional is fittedly inserted into said head socket having a corresponding shaped so as to increase a contacting surface area between said light head and said heat dissipating member.

7. A light source arrangement, as recited in claim 5, wherein said heat sink connector has an outer spiral threaded portion screwing with an inner spiral threaded portion of said head socket such that said light head is replaceably connected to said heat dissipating member.

8. A light source arrangement, as recited in claim 5, further comprising a circuit control device received in an interior of said heat dissipating member and arranged to electrically connect said electric input adapter with said circuit board for controlling a flow of current passing through.

9. A light source arrangement, as recited in claim 8, wherein said luminary element is a single bonded diode wherein one of said terminal electrodes is electrically connected to said supporting frame while another said terminal electrode is electrically connected to said circuit board.

10. A light source arrangement, as recited in claim 5, further comprising a circuit control device built in with said circuit board and arranged to electrically connect with said electric input adapter for controlling a flow of current passing through.

11. A light source arrangement, as recited in claim 10, wherein said luminary element is a single bonded diode wherein one of said terminal electrodes is electrically connected to said supporting frame while another said terminal electrode is electrically connected to said circuit board.

12. A light source arrangement, as recited in claim 10, wherein said luminary element is a double bonded diode wherein said two terminal electrodes of said double bonded diode are electrically connected to said circuit board in such a manner that said light is emitted by said luminary element when said two terminal electrodes are electrified.

13. A light source arrangement, as recited in claim 10, wherein said electric input adapter is formed at said base of said heat dissipating member and constructed as a universal adapter for electrically connecting with said power source.

14. A light source arrangement, as recited in claim 13, wherein said universal adapter is a plug for plugging into a conventional light bulb socket so as to electrically connect said light head with said power source while an AC current is used.

15. A light source arrangement, as recited in claim 8, wherein said luminary element is a double bonded diode wherein said two terminal electrodes of said double bonded diode are electrically connected to said circuit board in such a manner that said light is emitted by said luminary element when said two terminal electrodes are electrified.

16. A light source arrangement, as recited in claim 8, wherein said electric input adapter is formed at said base of said heat dissipating member and constructed as a universal adapter for electrically connecting with said power source.

17. A light source arrangement, as recited in claim 16, wherein said universal adapter is a plug for plugging into a conventional light bulb socket so as to electrically connect said light head with said power source while an AC current is used.

18. A light source arrangement, as recited in claim 5, wherein said luminary element is a single bonded diode wherein one of said terminal electrodes is electrically connected to said supporting frame while another said terminal electrode is electrically connected to said circuit board.

19. A light source arrangement, as recited in claim 18, wherein said electric input adapter is formed at said base of said heat dissipating member and constructed as a universal adapter for electrically connecting with said power source.

20. A light source arrangement, as recited in claim 14, wherein said universal adapter is a plug for plugging into a conventional light bulb socket so as to electrically connect said light head with said power source while an AC current is used.

21. A light source arrangement, as recited in claim 5, wherein said luminary element is a double bonded diode wherein said two terminal electrodes of said double bonded diode are electrically connected to said circuit board in such a manner that said light is emitted by said luminary element when said two terminal electrodes are electrified.

22. A light source arrangement, as recited in claim 21, wherein said electric input adapter is formed at said base of said heat dissipating member and constructed as a universal adapter for electrically connecting with said power source.

23. A light source arrangement, as recited in claim 22, wherein said universal adapter is a plug for plugging into a conventional light bulb socket so as to electrically connect said light head with said power source while an AC current is used.

24. A light source arrangement, as recited in claim 5, wherein said electric input adapter is formed at said base of said heat dissipating member and constructed as a universal adapter for electrically connecting with said power source.

25. A light source arrangement, as recited in claim 24, wherein said universal adapter is a plug for plugging into a conventional light bulb socket so as to electrically connect said light head with said power source while an AC current is used.

26. A light source arrangement, as recited in claim 4, wherein said luminary element is a single bonded diode wherein one of said terminal electrodes is electrically connected to said supporting frame while another said terminal electrode is electrically connected to said circuit board.

27. A light source arrangement, as recited in claim 4, wherein said luminary element is a double bonded diode wherein said two terminal electrodes of said double bonded diode are electrically connected to said circuit board in such a manner that said light is emitted by said luminary element when said two terminal electrodes are electrified.

28. A light source arrangement, as recited in claim 1, further comprising a heat dissipating member mounted to said dissipating end of said supporting frame for dissipating heat generated from said light head, wherein said heat dissipating member comprises a supporting ceiling having a central head socket, a base, and a plurality of heat dissipating blades integrally and spacedly extended from said supporting ceiling to said base in such a manner that said dissipating end is structured as a heat sink connector to fittedly insert into said head socket so as to mount said light head on said heat dissipating member.

29. A light source arrangement, as recited in claim 28, wherein said heat sink connector having a cog-liked cross sectional is fittedly inserted into said head socket having a corresponding shape so as to increase a contacting surface area between said light head and said heat dissipating member.

30. A light source arrangement, as recited in claim 28, wherein said heat sink connector has an outer spiral threaded portion screwing with an inner spiral threaded portion of said head socket such that said light head is replaceably connected to said heat dissipating member.

31. A light source arrangement, as recited in claim 28, wherein said electric input adapter is formed at said base of said heat dissipating member and constructed as a universal adapter for electrically connecting with said power source.

32. A light source arrangement, as recited in claim 31, wherein said universal adapter is a plug for plugging into a conventional light bulb socket so as to electrically connect said light head with said power source while an AC current is used.

33. A light source arrangement, comprising:

an electric input adapter for electrically connecting with a power source; and a light head, comprising:

a supporting frame having at feast a dissipating end and a peripheral surface provided thereon;

a light shelter sealedly mounted on said peripheral surface of said supporting frame, wherein said lighter shelter has a light projecting portion provided on said supporting frame; and a luminary unit comprising:

a circuit provided on said peripheral surface of said supporting frame and electrically connected with said electric input adapter, and at least a luminary element having two terminal electrodes, wherein said luminary element is supported by said supporting frame and electrically connected to said circuit for emitting light when said terminal electrodes are electrified, wherein said light shelter is adapted to sealedly protect said circuit board and said luminary element and said light projecting portion of said light shelter is provided on said supporting frame at a position aligning with said luminary element in such a manner that a light produced by said luminary element is arranged to pass through said light projecting portion of said light shelter to outside.

34. A light source arrangement, as recited in claim 33, further comprising a heat dissipating member mounted to said dissipating end of said supporting frame for dissipating heat generated from said light head, wherein said heat dissipating member comprises a supporting ceiling having a central head socket, a base, and a plurality of heat dissipating blades integrally and spacedly extended from said supporting ceiling to said base in such a manner that said dissipating end is structured as a heat sink connector to fittedly insert into said head socket so as to mount said light head on said heat dissipating member.

35. A light source arrangement, as recited in claim 34, wherein said electric input adapter is formed at said base of said heat dissipating member and constructed as a universal adapter for electrically connecting with said power source.

36. A light source arrangement, as recited in claim 35, wherein said universal adapter is a plug for plugging into a conventional light bulb socket so as to electrically connect said light head with said power source while an AC current is used.

37. A light source arrangement, as recited in claim 33, further comprising a circuit control device received in an interior of said heat dissipating member and arranged to electrically connect said electric input adapter with said circuit board for controlling a flow of current passing through.

38. A light source arrangement, as recited in claim 33, further comprising a circuit control device built in with said circuit board and arranged to electrically connect with said electric input adapter for controlling a flow of current passing through.

39. A light source arrangement, comprising:

an electric input adapter for electrically connecting with a power source; and a light head, comprising:

a supporting frame having at least a dissipating end and a peripheral surface provided thereon;

a luminary unit comprising:

a circuit provided on said peripheral surface of said supporting frame and electrically connected with said electric input adapter, and at least a luminary element having two terminal electrodes, wherein said luminary element is supported by said supporting frame and electrically connected to said circuit for emitting light when said terminal electrodes are electrified; and a heat dissipating member mounted to said dissipating end of said supporting frame for dissipating heat generated from said light head, wherein said heat dissipating member comprises a supporting ceiling having a central head socket, a base, and a plurality of heat dissipating blades integrally and spacedly extended from said supporting ceiling to said base in such a manner that said dissipating end is structured as a heat sink connector to fittedly insert into said head socket so as to mount said light head on said heat dissipating member.

40. A light source arrangement, as recited in claim 39, further comprising a circuit control device received in an interior of said heat dissipating member and arranged to electrically connect said electric input adapter with said circuit board for controlling a flow of current passing through.

41. A light source arrangement, as recited in claim 39, further comprising a circuit control device built in with said circuit board and arranged to electrically connect with said electric input adapter for controlling a flow of current passing through.

42. A light source arrangement, comprising:

an electric input adapter for electrically connecting with a power source; and a light head, comprising:

a supporting frame having at least a dissipating end and a peripheral surface provided thereon; and a luminary unit comprising:

a circuit provided on said peripheral surface of said supporting frame and electrically connected with said electric input adapter, and at least a luminary element having two terminal electrodes, wherein said luminary element is supported by said supporting frame and electrically connected to said circuit for emitting light when said terminal electrodes are electrified, wherein said luminary element is a double bonded diode wherein said two terminal electrodes of said double bonded diode are electrically connected to said circuit in such a manner that said light is emitted by said luminary element when said two terminal electrodes are electrified.

* * * * *